US011391423B2

(12) United States Patent
Cattivelli et al.

(10) Patent No.: US 11,391,423 B2
(45) Date of Patent: Jul. 19, 2022

(54) MULTIFUNCTION LED LIGHTING DEVICE

(71) Applicant: FOND-PELL S.R.L., Palosco (IT)

(72) Inventors: Fabrizio Cattivelli, Palosco (IT); Giovanni Leali, Palosco (IT); Emanuele Pellegrini, Palosco (IT); Ilenia Pellegrini, Palosco (IT); Matteo Pellegrini, Palosco (IT)

(73) Assignee: FOND-PELL S.R.L., Palosco (IT)

( * ) Notice: Subject to any disclaimer, the term of this patent is extended or adjusted under 35 U.S.C. 154(b) by 0 days.

(21) Appl. No.: 17/395,919

(22) Filed: Aug. 6, 2021

(65) Prior Publication Data

US 2022/0042661 A1 Feb. 10, 2022

(30) Foreign Application Priority Data

Aug. 6, 2020 (IT) ..... 102020000019426

(51) Int. Cl.

| | |
|---|---|
| ***F21S 4/28*** | (2016.01) |
| ***F21S 9/02*** | (2006.01) |
| ***F21V 21/26*** | (2006.01) |
| ***F21V 23/00*** | (2015.01) |
| ***F21V 23/06*** | (2006.01) |
| *F21Y 115/10* | (2016.01) |

(52) U.S. Cl.

CPC . *F21S 4/28* (2016.01); *F21S 9/02* (2013.01); *F21V 21/26* (2013.01); *F21V 23/004* (2013.01); *F21V 23/06* (2013.01); *F21Y 2115/10* (2016.08)

(58) Field of Classification Search

CPC .... F21S 4/28; F21S 9/02; F21V 21/26; F21V 23/004; F21V 23/06

See application file for complete search history.

(56) References Cited

U.S. PATENT DOCUMENTS

2008/0091250 A1* 4/2008 Powell ..... H05B 45/20 607/90
2008/0198608 A1* 8/2008 Mast ..... F21V 27/00 362/392

(Continued)

FOREIGN PATENT DOCUMENTS

CN 106090715 A * 11/2016

OTHER PUBLICATIONS

English translation of CN-106090715 Dai, Nov. 2016 (Year: 2016).*

*Primary Examiner* — Evan P Dzierzynski
(74) *Attorney, Agent, or Firm* — Nixon & Vanderhye

(57) ABSTRACT

A multifunction LED lighting device improves technical and functional performance compared to known lighting appliances, while also optimizing yield and satisfying demand for aesthetics and reduced consumption. The device includes: a lighting body including an LED assembly; a frame for connecting to the wall and supporting the at least a lighting body; an electrical connection and mechanical connection between the frame and the at least a lighting body; and an electronic circuit board for converting to low voltage and supplying power to the LED assembly. The lighting body is substantially L-shaped and includes an upright and a projecting arm. The upright includes the electrical connection and the mechanical connection, and the arm includes the LED assembly. The electrical connection and the mechanical connection include a connector of male/female type with reversible coupling.

13 Claims, 7 Drawing Sheets

(56) References Cited

U.S. PATENT DOCUMENTS

| | | | | |
|---|---|---|---|---|
| 2008/0278935 | A1* | 11/2008 | Lin | A45D 42/10 362/183 |
| 2010/0039792 | A1* | 2/2010 | Meyers | H01R 25/006 362/183 |
| 2014/0029248 | A1* | 1/2014 | Dyson | F21V 21/14 362/244 |
| 2015/0159825 | A1* | 6/2015 | Flynn | H01R 33/9453 362/183 |
| 2019/0341793 | A1* | 11/2019 | Chien | F21V 23/06 |
| 2021/0254817 | A1* | 8/2021 | Dyson | F21S 6/006 |

* cited by examiner

MULTIFUNCTION LED LIGHTING DEVICE

CROSS-REFERENCE TO RELATED APPLICATIONS

This application claims priority to Italian Application No. 102020000019426 filed Aug. 6, 2020, the entire contents of each of which are hereby incorporated by reference.

BACKGROUND OF THE INVENTION

Field of the Invention

The invention relates to the lighting technology sector: in particular the invention concerns a multifunction LED lighting device, which can be used to light indoor and outdoor environments.

Description of the Related Art

Among the many types of known lighting devices, LED lighting devices for wall mounting are very common.

The term wall is used hereinafter in its broadest and most general meaning, not only to define wall structures in construction materials but also simple partition walls, and to define both vertical walls and horizontal ceilings.

LED lighting devices generally comprise:

- at least one lighting body comprising an LED assembly;
- a frame for connecting to the wall and supporting said at least a lighting body;
- electrical connection means of said at least one lighting body to an electrical system and to specific switch-on means;
- mechanical connection means between said frame and said at least one lighting body;
- an electronic circuit board for converting to low voltage and supplying power to said LED assembly.

Conventional lighting devices have a fixed and defined configuration; they are sold with their mechanical parts already assembled, while they require to be electrically connected by a technician. The user is then required to screw in the LED bulb or the LED assembly preferred.

The geometry and the overall dimensions of conventional lighting devices cannot be varied; the lighting point and its light cone are substantially predefined.

Being already assembled, during storage in warehouses and during sale and transport, the lighting devices are unfavourably bulky and delicate to handle and move.

Conventional lighting devices, above all if destined to be fixed to a wall, partition or ceiling, do not as a rule perform accessory functions.

SUMMARY OF THE INVENTION

The object of the invention is to eliminate these drawbacks, improving technical and functional performances with respect to prior art lighting appliances, also optimizing yield and satisfying the increasingly demanding requests for aesthetics and reduced consumption.

The object of the invention is to produce an LED lighting device that can be assembled, also directly by the user, based on lighting requirements, which is multifunction and can thus function as mobile emergency light, even without a power supply or as a power supply for external electronic devices.

A further object of the invention is to produce a lighting device that is practical, easy to handle and has small overall dimensions when disassembled; easy, immediate and intuitive in the assembly step; with clean lines and aesthetically pleasing when operating.

These objects are achieved with a multifunction LED lighting device comprising:

- at least one lighting body comprising an LED assembly;
- a frame for connecting to the wall and supporting said at least a lighting body;
- electrical connection means and mechanical connection means between said frame and said at least a lighting body;
- an electronic circuit board for converting to low voltage and supplying power to said LED assembly, characterized in that:

- said lighting body is substantially L-shaped and comprises an upright and a projecting arm, where said upright comprises said electrical connection means and said mechanical connection means and said arm comprises said LED assembly;
- said electrical connection means and said mechanical connection means comprise a connector of male/female type with reversible coupling.

Advantageously, said lighting device comprises a buffer battery, operatively connected to said LED assembly, adapted to maintain said lighting device active even without a power supply.

Preferably, said buffer battery is arranged inside said lighting body.

In a preferred variant of the invention, said electrical connection means, produced by means of said connector of male/female type with reversible coupling, are of the electromagnetic induction type and are adapted to charge said buffer battery.

Moreover, said multifunction LED lighting device comprises a position sensor adapted to detect the presence of a subject and to selectively control the transfer of current from said buffer battery to said LED assembly.

Alternatively, said buffer battery is arranged in said frame.

According to a first aspect of the invention, said frame comprises:

- a plate for fixing to the wall;
- a base adapted to house the female component of said connector, where the male component thereof is housed at one end of said upright.

In a preferred variant of the invention, said frame comprises a stem, arranged between said plate for fixing to the wall and said base, where said stem comprises, at a first end, bayonet type mechanical connection means with said base and, at a second end, screw type mechanical connection means with said plate.

Advantageously, said stem is hollow and is adapted to be passed through by electrical cables terminating with a quick coupling connector adapted to coact with a corresponding connector associated with said base.

According to further aspects of the invention:

- said electronic circuit board is housed alternatively in said plate for fixing to the wall or in said base;
- said base comprises an LED assembly connected to said buffer battery and to said electronic circuit board;
- said base comprises a connector of USB type for supplying power to external electronic devices;
- said base comprises accessory electronic apparatus selected from a microphone, a display, a video camera, adapted to interface in Bluetooth or Wi-Fi mode with a user to fulfil various functions.

The main advantage of the invention is the modularity and versatility of the lighting device.

During storage and transport the device has limited overall dimensions, without protruding or projecting portions that could be accidentally broken.

During assembly, it is possible to arrange the lighting bodies in different positions on the frame, illuminating only the areas necessary, with savings in consumption and satisfying requirements of an aesthetic nature.

The electrical and mechanical connection means are quick coupling through interference with form fitting of male/female type, simple and quick to couple; assembly of the device is therefore rapid and simple.

The electrical connection means of the electromagnetic induction charging type supply direct current to said buffer battery provided in the lighting body, ensuring the maximum degree of safety for users and/or operators according to current legislations, according to which electric devices must be manufactured so that it is not possible to accidentally come into contact with live parts.

The device comprises a buffer battery that allows the device to be maintained at least partially active even without a power supply, thereby acting as an emergency light.

Advantageously, when said buffer battery is provided in the lighting body, this can be easily detached from the frame and used as a torch to move around in dark places. In this case, the L-shape of said lighting body also makes it easy to hold along its upright.

In an advantageous variant, said base also comprises an LED assembly connected to a buffer battery, so that the device itself, in addition to the lighting bodies, acts as an emergency light.

In the ceiling mounted variant of the lighting device, the frame is produced by means of several components that are however all easy to assembly by means of quick coupling means, both of bayonet and screw type.

The mechanical connection means themselves also produce the electrical connection between the lighting body and electrical system, so that the user is not required to handle wires or other dangerous parts.

Said lighting device is multifunction: besides conventional lighting, as already stated it can also act as an emergency light, portable torch, charger of external electronic devices (due to a USB socket with which it can be equipped).

BRIEF DESCRIPTION OF THE DRAWINGS

These and other advantages of the invention will be more evident below, in the description of preferred embodiments provided purely by way of non-limiting example, and with the aid of the figures, wherein.

DESCRIPTION OF THE PREFERRED EMBODIMENTS

Figure 3:
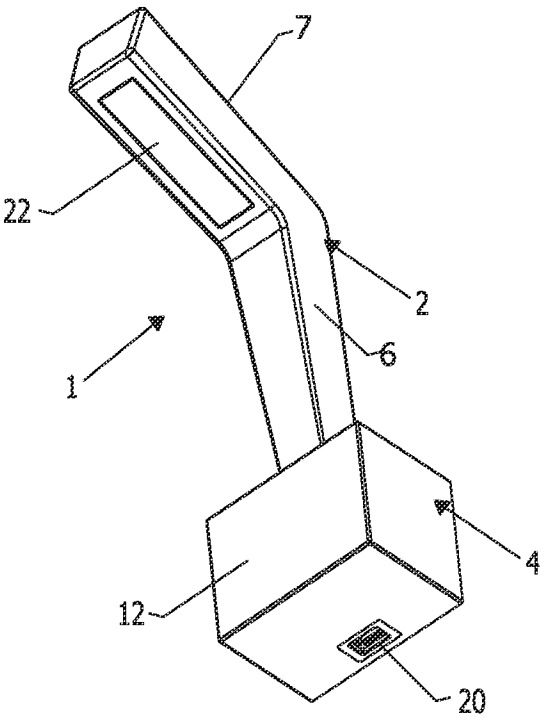
FIGS. 1, 2 and 3 represent, in an axonometric view from different angles, a multifunction LED lighting device according to a first variant of the invention.
Figure 2:
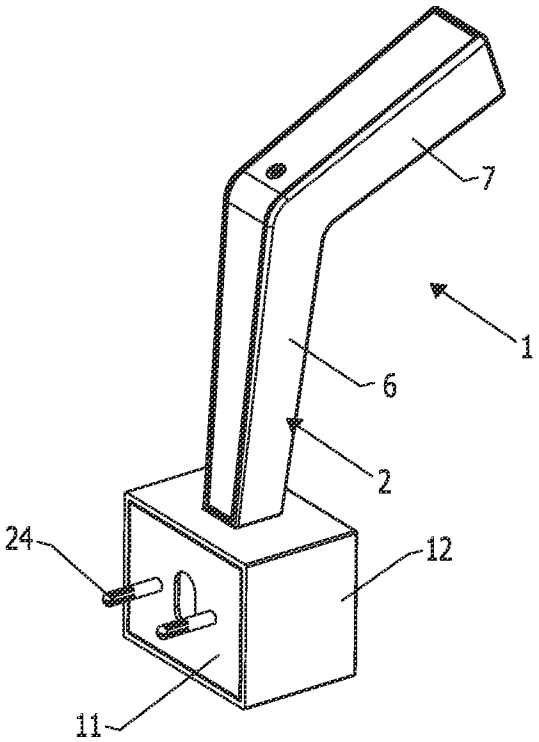
Figure 1:
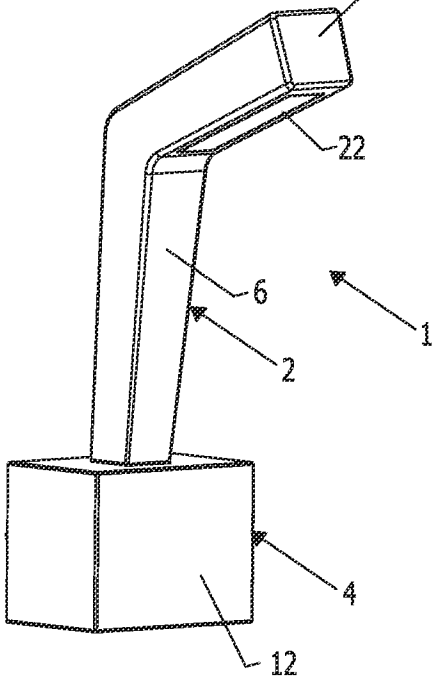

With reference to FIGS. 1-5, there is illustrated a multifunction LED lighting device 1 according to a first embodiment of the invention.

Said LED lighting device 1 comprises:

- a lighting body 2 comprising internally an LED assembly 3;
- a frame 4 for supporting said lighting body 2 and for connecting it to a vertical wall;
- electrical connection means and mechanical connection means between said frame 4 and said lighting body 2;
- an electronic circuit board 5 for converting to low voltage and supplying power to said LED assembly 3.

Said lighting body 2 is substantially L-shaped and comprises an upright 6 and a projecting arm 7.

Figure 4:
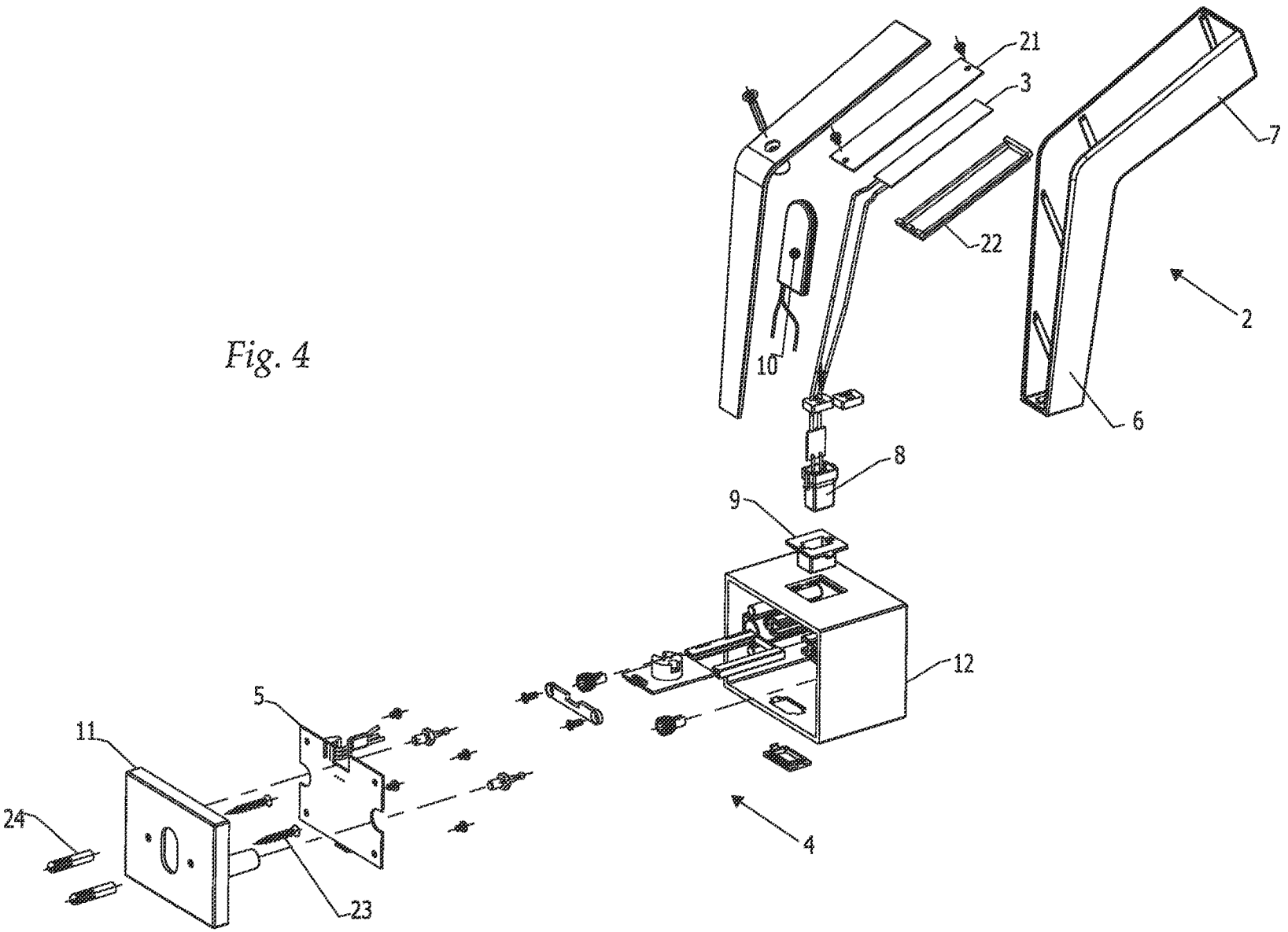
FIGS. 4 and 5 represent, in an exploded axonometric view, the lighting device of FIG. 1.
Figure 5:
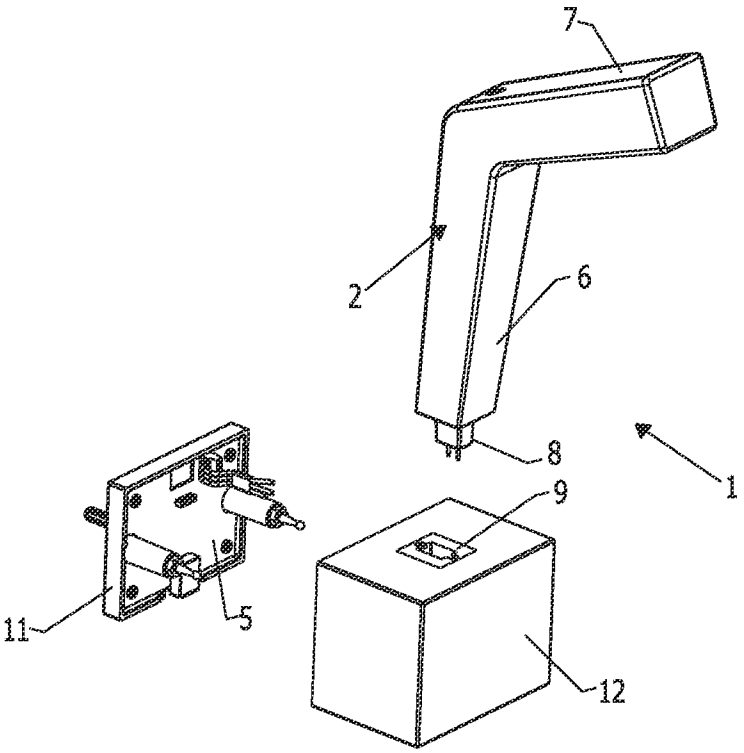
Figure 8:
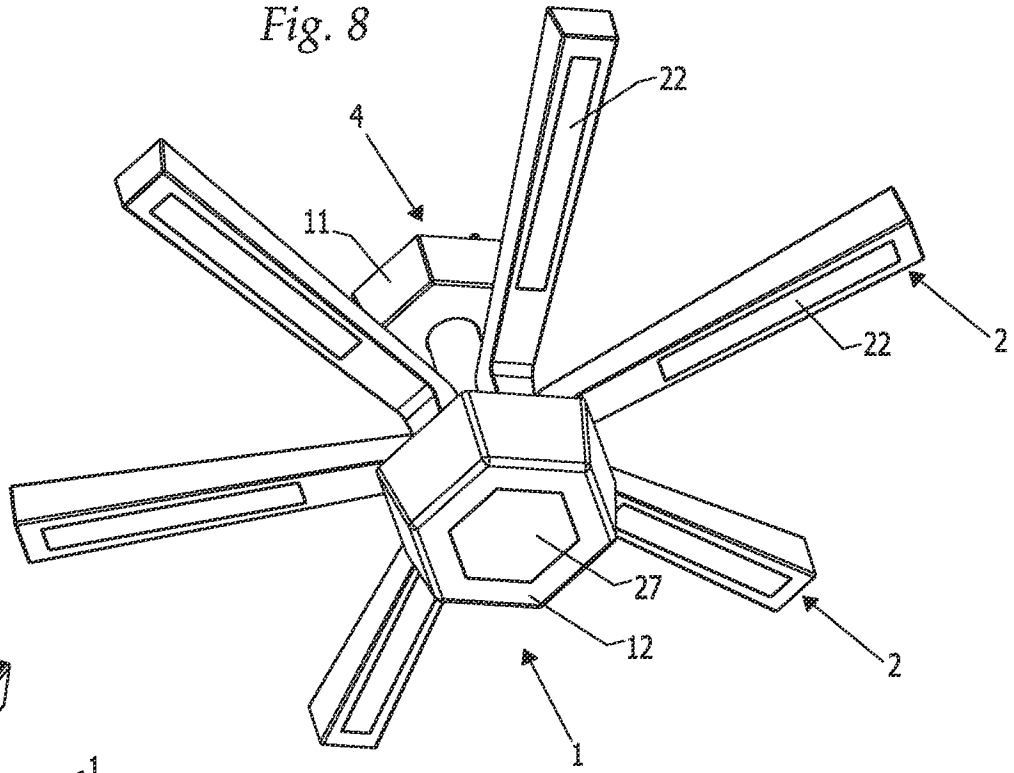
FIGS. 7 and 8 represent, in an axonometric view from different angles, a multifunction LED lighting device according to a third variant of the invention.
Figure 7:
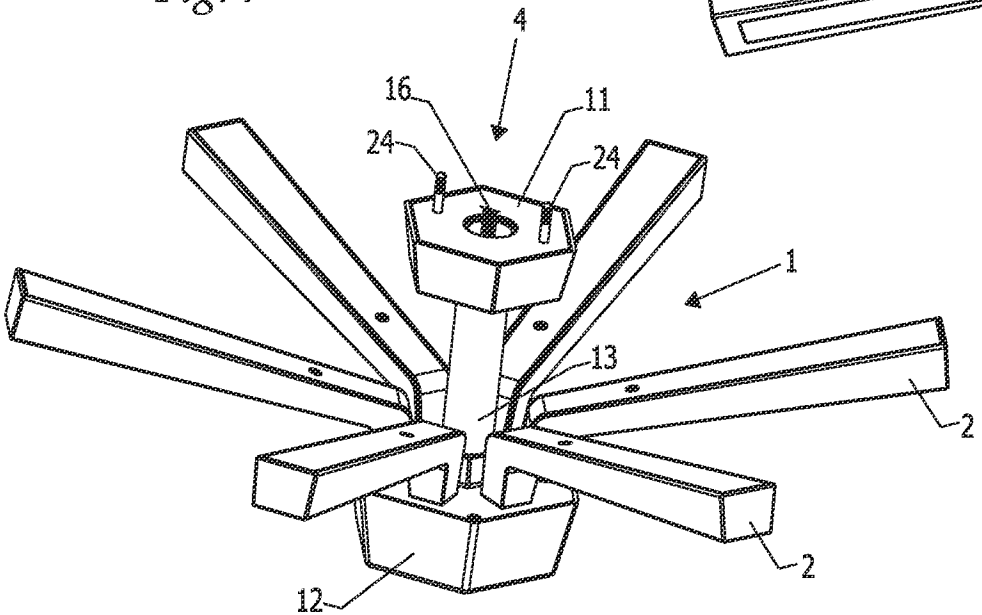
Figure 9:
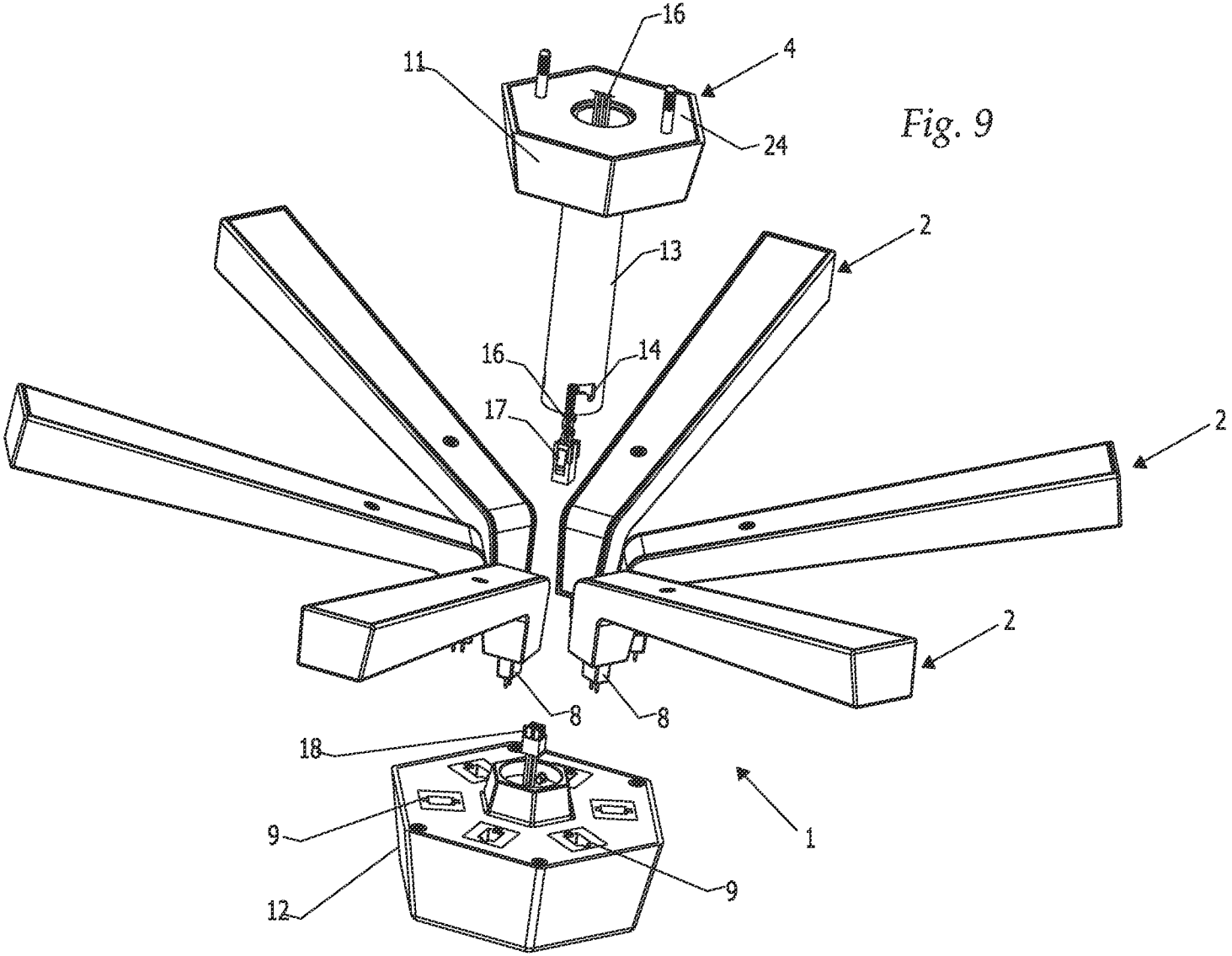
FIG. 9 represents, in an exploded axonometric view, the lighting device of FIG. 7.
Figure 12:
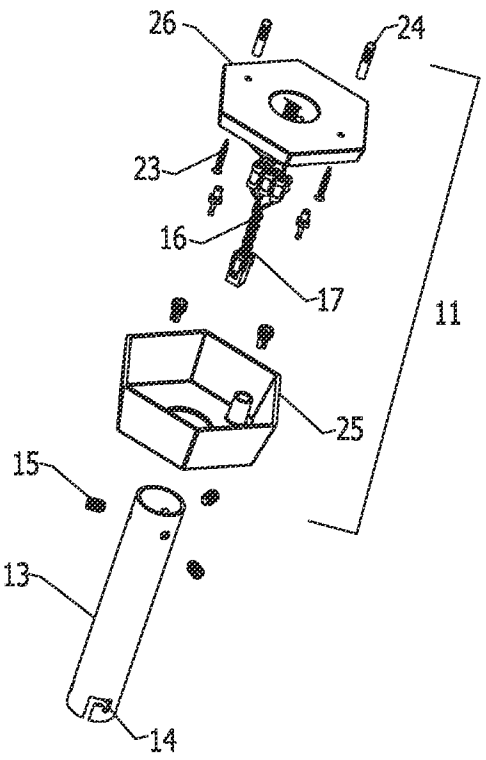
FIGS. 10, 11 and 12 represent, in an exploded axonometric view, components of the lighting device of FIG. 9.
Figure 11:
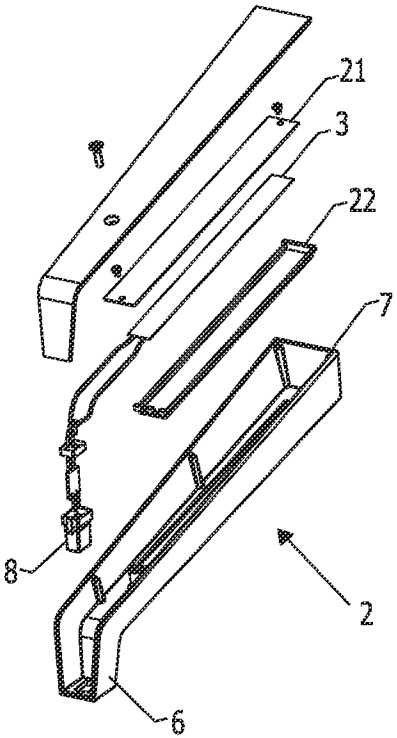
Figure 10:
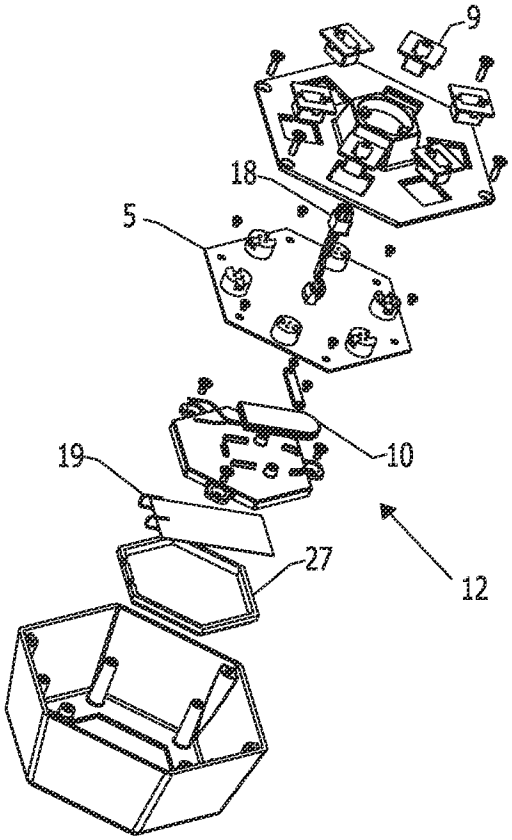

With particular reference to the details of the exploded views in FIGS. 4 and 5, said upright 6 comprises said electrical connection means and said mechanical connection means to said frame, while said arm 7 contains internally said LED assembly 3.

Said LED assembly 3 is retained between a supporting plate 21 and a lens 22.

Said electrical connection means and said mechanical connection means are produced by a single connector 8, 9 of male/female type with reversible coupling, which therefore allows easy removal and repositioning of the lighting body 2 from and on the frame 4 during assembly and wall mounting of the device 1.

In fact, said frame 4 comprises a plate 11 for fixing to the vertical wall, by means of screws 23 and wall plugs 24, and a substantially parallelepiped shaped hollow base 12.

Said base 12 can be fixed with interlock on said plate 11.

Said electronic circuit board 5 is housed in said plate 11 for fixing to the wall, while said base 12 is adapted to house the female component 9 of said connector. The corresponding male component 8 of the connector itself is housed at one end of the upright 6 of the lighting body 2.

A low voltage current transformer is associated with said electronic circuit board 5.

Said LED lighting device 1 comprises a buffer battery 10 adapted to maintain said device active even without a power supply.

Said buffer battery 10 is housed in said lighting body 2, inside the upright 6. In this way it is possible to disconnect said lighting body 2 from the frame 4 and use it as a torch and emergency light.

Said upright 6, id of suitable length, can be used as handle of the lighting body 2 when used as torch.

Said base 12 comprises, in its lower face, a connector 20 of USB type for supplying power to external electronic devices.

Figure 15:
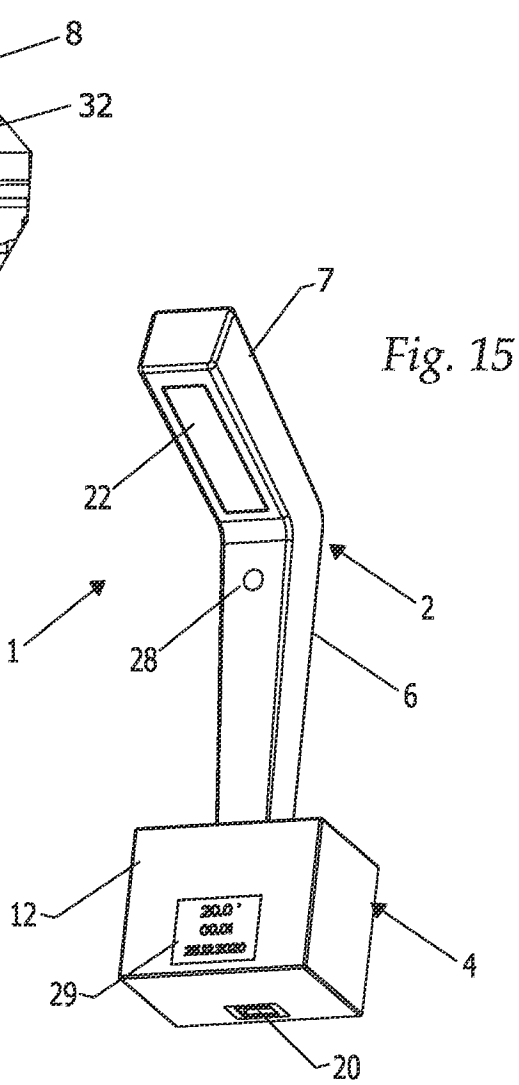
FIG. 15 represents, in an axonometric view, the multifunction LED lighting device of FIG. 1 in a more complete variant.

With reference to FIG. 15, said base 12 comprises accessory electronic apparatus 29 selected from a microphone, a display, a video camera, adapted to interface with a user in Bluetooth or Wi-Fi mode and with a home automatic system to fulfil various functions, and make the multifunction LED lighting device 1 even more complete and high performing.

Figure 6:
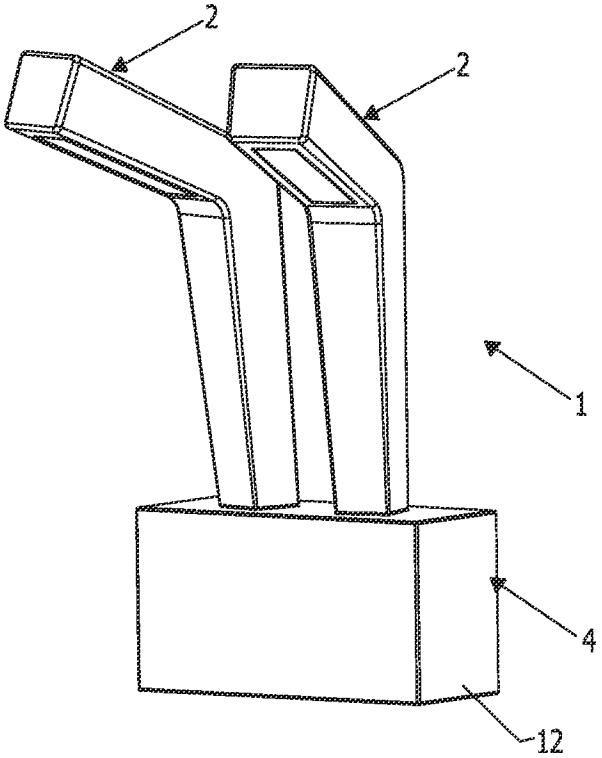
FIG. 6 represents, in an axonometric view, a multifunction LED lighting device according to a second variant of the invention.

FIG. 6 illustrates a multifunction LED lighting device 1 substantially identical to the one described above, except for the fact that it comprises two lighting bodies 2, each provided with its own electrical and mechanical connection means, where said lighting bodies 2 can be alternatively or simultaneously inserted into the frame 4.

Figure 14:
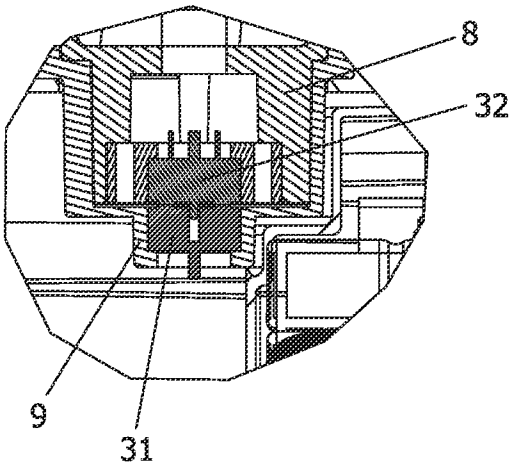
FIGS. 13 and 14 represent, respectively in an assembly section along a vertical plane and in a detail section, a multifunction LED lighting device according to a further possible variant of the invention.
Figure 13:
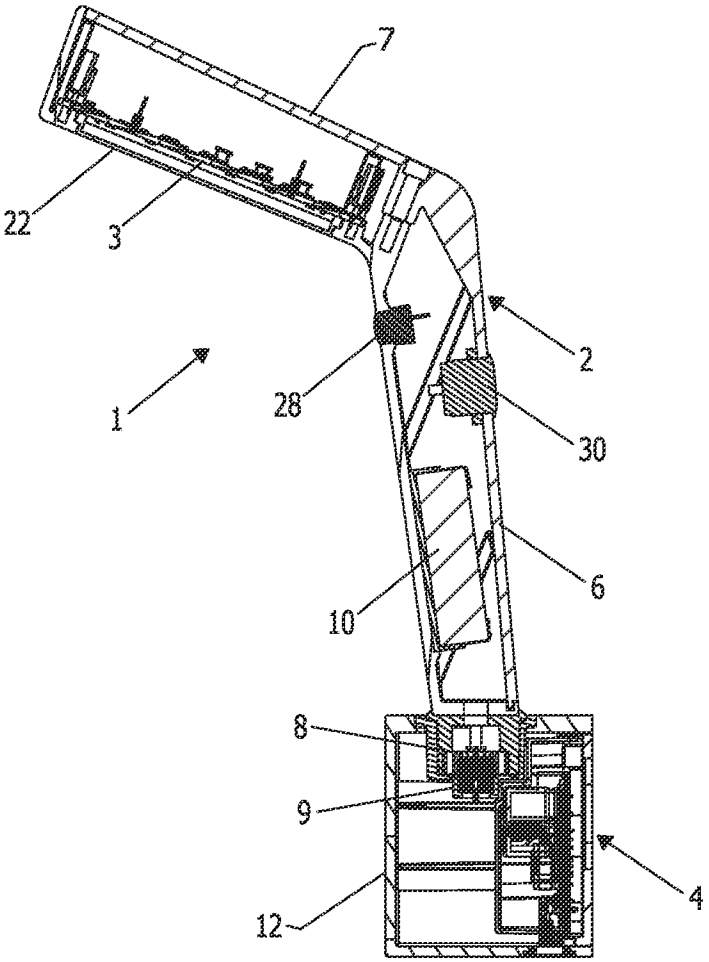

FIGS. 13 and 14 illustrate a section of the multifunction LED lighting device 1 according to a variant of the invention, where the electrical connection means between said frame 4 and said lighting body 2 are of the electromagnetic induction charging type.

The direct physical contact between said frame 4, in particular the base 12 that houses the female component 9 of said connector, and said lighting body 2, in particular the end of the upright 6 that houses the male component 8 of said connector, allows activation of the passage of current through magnetic induction inside the buffer battery 10 which will then supply said LED assembly 3 with power.

Due to transfer by means of magnetic induction, it is possible to charge the buffer battery 10 of the lighting body 2, through specific transmitter sensors 31 positioned on the base 12 in the female component 9 of the connector and specific receiver sensors 32 residing on the lighting body in the male component 8 of the connector.

Said buffer battery 10 in this case performs an important role in the operation of the LED lighting device 1: it does not only come into play only in the case of a power outage or in the case in which the lighting appliance 1 is used as a torch, but is always required for the operation of the LED assembly 3, as there are no physical electrical connections between the base 12 and the lighting body 2.

To optimize consumption, said LED lighting device 1 comprises a position sensor 28 adapted to detect the physical presence or absence of a moving subject close to the lighting device 1 and to selectively control the transfer of current from said buffer battery 10 to said LED assembly 3 and hence switching on, or not, of the lighting body 2.

Moreover, said LED lighting device 1 comprises a switch 30 of ON/OFF type, also adapted to act on the passage of current from the buffer battery 10 to the LED assembly 3.

The electrical connection means of electromagnetic induction type give the maximum level of safety to the multifunction LED lighting device 1, which in this way has no open physical electrical contacts.

With reference to FIGS. 7-12, there is illustrated a multifunction LED lighting device 1 according to a further and original embodiment, in particular suitable to be ceiling mounted and to operate as a ceiling light.

Said base 12 has a hexagonal parallelepiped shape and said lighting device 1 comprises six lighting bodies 2 arranged radially on said base 12. It is clear that the number of the lighting bodies 2 can vary, and also in this case, the electric and mechanical connection means of reversible type 8, 9 allow a variable composition of the lighting device 1, as the number and position of the lighting bodies 2 can be selected.

Said frame 4 comprises a stem 13, arranged between said plate 11 for fixing to the ceiling and said base 12, where said stem 13 comprises, at a first end, bayonet type mechanical connection means 14 with said base 12 and, at a second end, screw type mechanical connection means 15 with said plate 11.

Said plate 11 also has a hexagonal parallelepiped shape and comprises a box-like body 25 and a closing wall 26.

Said stem 13 is hollow and is adapted to be passed through by electrical cables 16 terminating with a quick coupling connector 17 adapted to coact with a corresponding connector 18 associated with said base 12.

In said variant, said electronic circuit board 5 is housed in said base 12.

The lower face of said base 12, which in use faces the room to be illuminated, comprises a lens 27 and said base 12 also comprises an LED assembly 19 adapted to emit light through said lens 27.

Inside said base 12 there is also housed a buffer battery 10 connected to said additional LED assembly 19 and to said electronic circuit board 5: in this variant it is the frame 4 itself that operates as a fixed emergency light as the lighting bodies 2 cannot be easily picked up to be used as a torch due to the fact that the lighting device 1 is positioned on the ceiling.

As is apparent to those skilled in the art, the invention can be produced in numerous variants of forms and dimensions, always achieving the advantages set forth above.

The invention claimed is:

1. A multifunction LED lighting device comprising:

a lighting body that is substantially L-shaped and comprises an upright portion connected to a projecting arm;

an LED assembly located internally within the projecting arm;

a buffer battery operatively connected to the LED assembly to maintain the LED assembly active without an external power supply;

a frame that removably connects to the upright portion of the lighting body, wherein with the frame connected to the upright portion of the light body the frame supports the lighting body and connects the lighting body to the wall to support the light device on the wall;

an electronic circuit board housed in the frame and connected to the buffer battery and to the LED assembly, the electronic circuit board for converting power to low voltage power and supplying the low voltage power to the LED assembly and to charge the buffer battery; and a male/female connector, part of the male/female connector being located in the upright portion and another part of the male/female connector being located in the frame, the male/female connector reversibly mechanically and electrically coupling the lighting body to the frame so that, i) with the lighting body coupled to the frame, the frame supports the lighting body and the electronic circuit board powers the LED assembly when the electronic circuit board produces the low voltage power, ii) with the lighting body uncoupled and separated from the frame, the lighting body functions as a portable emergency light with the buffer battery powering the LED assembly without any external power supply and the upright portion serving as a handle of the light body, and iii) with the lighting body coupled to the frame, the frame supports the lighting body and the buffer battery powers the LED assembly when the electronic circuit board does not produce the low voltage power.

2. The multifunction LED lighting device according to claim 1, wherein said buffer battery is housed inside the lighting body.

3. The multifunction LED lighting device according to claim 2, wherein said buffer battery is arranged inside the upright portion of said lighting body.

4. The multifunction LED lighting device according to claim 3, wherein said male/female connector is an electromagnetic induction connector adapted to charge said buffer battery via magnetic induction.

5. The multifunction LED lighting device according to claim 2, further comprising a position sensor adapted to detect the presence of a subject and to selectively control the transfer of current from said buffer battery to said LED assembly.

6. The multifunction LED lighting device according to claim 1, wherein said frame comprises:

a plate for fixing the frame to the wall; and a base adapted to house a female component of said male/female connector, where a male component thereof is housed at one end of said upright portion.

7. The multifunction LED lighting device according to claim 6, wherein said frame comprises a stem, arranged between said plate for fixing to the wall and said base, where said stem comprises, at a first end, bayonet type mechanical connection means with said base and, at a second end, screw type mechanical connection means with said plate.

8. The multifunction LED lighting device according to claim 7, wherein said stem is hollow and is adapted to be passed through by electrical cables terminating with a quick coupling connector adapted to coact with a corresponding connector associated with said base.

9. The multifunction LED lighting device according to claim 6, wherein said electronic circuit board is housed in said plate for fixing to the wall.

10. The multifunction LED lighting device according to claim 6, wherein said base comprises a connector of USB type for supplying power to external electronic devices.

11. The multifunction LED lighting device according to claim 6, wherein said base comprises accessory electronic apparatus selected from a microphone, a display, a video camera, adapted to interface in Bluetooth or Wi-Fi mode with a user to fulfil various functions.

12. The multifunction LED lighting device according to claim 6, wherein said electronic circuit board is housed in said base.

13. The multifunction LED lighting device according to claim 1, wherein said frame comprises:

a plate for fixing the frame to the wall;

a base adapted to house a female component of said connector, where a male component thereof is housed at one end of said upright portion; and wherein said base comprises a further LED assembly connected to said buffer battery and to said electronic circuit board.

* * * * *